US006530769B1

(12) United States Patent
Rondeau et al.

(10) Patent No.: US 6,530,769 B1
(45) Date of Patent: Mar. 11, 2003

(54) AUTOMATED MOLD CHANGING SYSTEM FOR CONCRETE PRODUCT MOLDING MACHINES AND METHODS OF CONSTRUCTING AND OPERATING THE SYSTEM

(75) Inventors: Duane A. Rondeau, Alpena, MI (US); James W. DeWyre, Alpena, MI (US); Laurie Delekta, Rogers City, MI (US)

(73) Assignee: Besser Company, Alpena, MI (US)

( * ) Notice: Subject to any disclaimer, the term of this patent is extended or adjusted under 35 U.S.C. 154(b) by 43 days.

(21) Appl. No.: 09/656,513

(22) Filed: Sep. 7, 2000

Related U.S. Application Data

(60) Provisional application No. 60/152,743, filed on Sep. 8, 1999.

(51) Int. Cl.[7] ..... B28B 3/00; B29C 33/00

(52) U.S. Cl. ..... 425/186; 425/195; 425/253; 425/454; 425/432; 29/428; 414/806; 414/815

(58) Field of Search ..... 425/186, 193, 425/195, 253, 432, 454; 29/428; 414/806, 815

(56) References Cited

U.S. PATENT DOCUMENTS

| | | | | |
|---|---|---|---|---|
| 816,613 A | | 4/1906 | Silva | |
| 3,659,986 A | * | 5/1972 | Gelbman | 425/123 |
| 3,704,979 A | | 12/1972 | Thiessen | |
| 3,860,375 A | | 1/1975 | Kinslow, Jr. et al. | |
| 3,969,061 A | * | 7/1976 | Fisher et al. | 425/150 |
| 4,235,580 A | | 11/1980 | Springs et al. | |
| 4,265,297 A | | 5/1981 | Asakuma et al. | |
| 4,312,242 A | | 1/1982 | Wallis | |
| 4,334,851 A | | 6/1982 | Wieser | |
| 4,462,783 A | | 7/1984 | Hehl | |
| 4,472,127 A | | 9/1984 | Cyriax et al. | |
| 4,518,338 A | | 5/1985 | Hehl | |
| 4,529,371 A | | 7/1985 | Nickley | |
| 4,555,228 A | | 11/1985 | Nishiike et al. | |
| 4,702,685 A | | 10/1987 | Fruntzek | |
| 4,795,334 A | | 1/1989 | Kitahara | |
| 4,941,813 A | | 7/1990 | Grubb, Jr. et al. | |
| 4,946,358 A | | 8/1990 | Okuda et al. | |
| 5,002,711 A | | 3/1991 | Iwama et al. | |
| 5,211,966 A | | 5/1993 | Raudies et al. | |
| 5,219,587 A | | 6/1993 | Seto et al. | |
| 5,362,434 A | | 11/1994 | Hauser et al. | |
| 5,394,599 A | | 3/1995 | Kubota et al. | |
| 5,505,600 A | * | 4/1996 | Ureshino et al. | 425/186 |
| 5,580,587 A | | 12/1996 | Leonhartsberger et al. | |
| 5,952,015 A | | 9/1999 | DeWyre et al. | |

* cited by examiner

*Primary Examiner*—Jan H. Silbaugh
*Assistant Examiner*—Donald Heckenberg
(74) *Attorney, Agent, or Firm*—Reising Ethington, Barnes, Kisselle, Learman & McCulloch, P.C.

(57) ABSTRACT

A concrete product molding machine has a mold removal and replacement mechanism which includes a transfer carriage movable from a location remote from mold supports on the machine along a pathway leading longitudinally abeam of the mold supports. Motor mechanism is activatable for moving a transfer carriage longitudinally adjacent to the machine, moving a cross carriage transversely inward, raising an elevator platform to deposit a mold thereon, returning the cross carriage transversely, and moving the transfer carriage longitudinally to remove the mold to a position adjacent to a mold deposit and replacement station. The mold is deposited at the mold deposit and replacement station and a replacement mold is deposited on the removal and replacement mechanism to be transferred to the concrete molding machine.

16 Claims, 14 Drawing Sheets

F
10
11
C
M
40
42
43
12
S
41
42
44
13

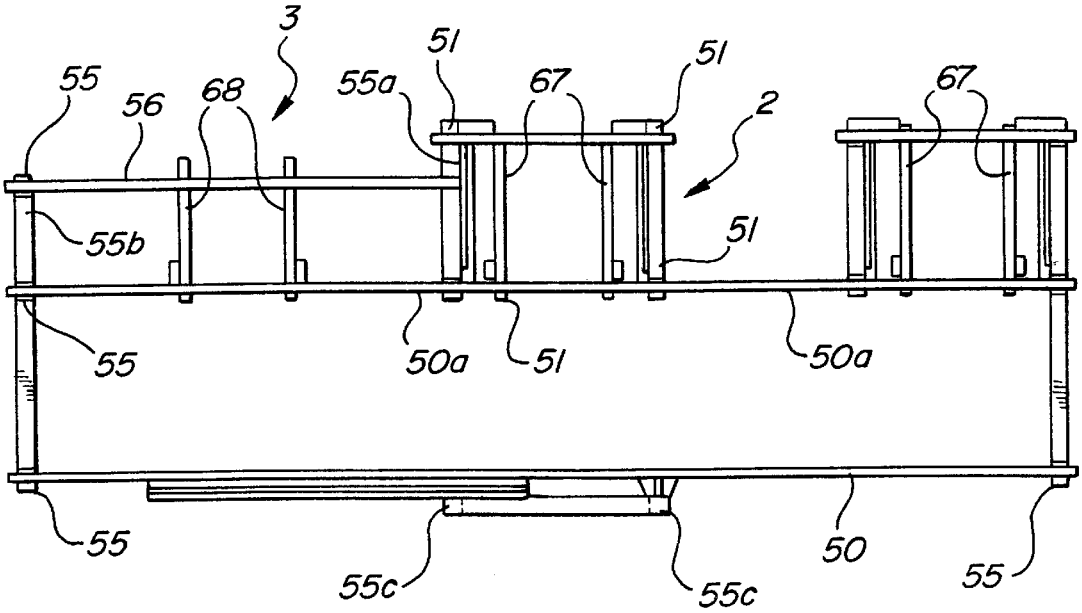
FIG-3
FIG-4
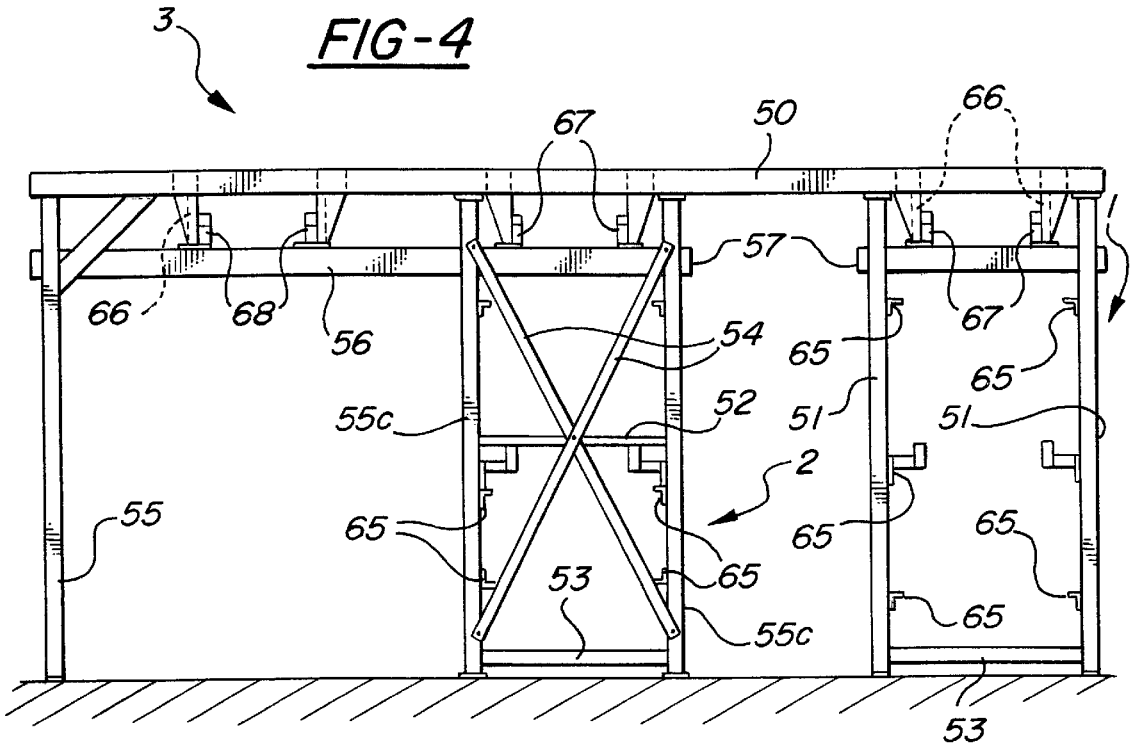

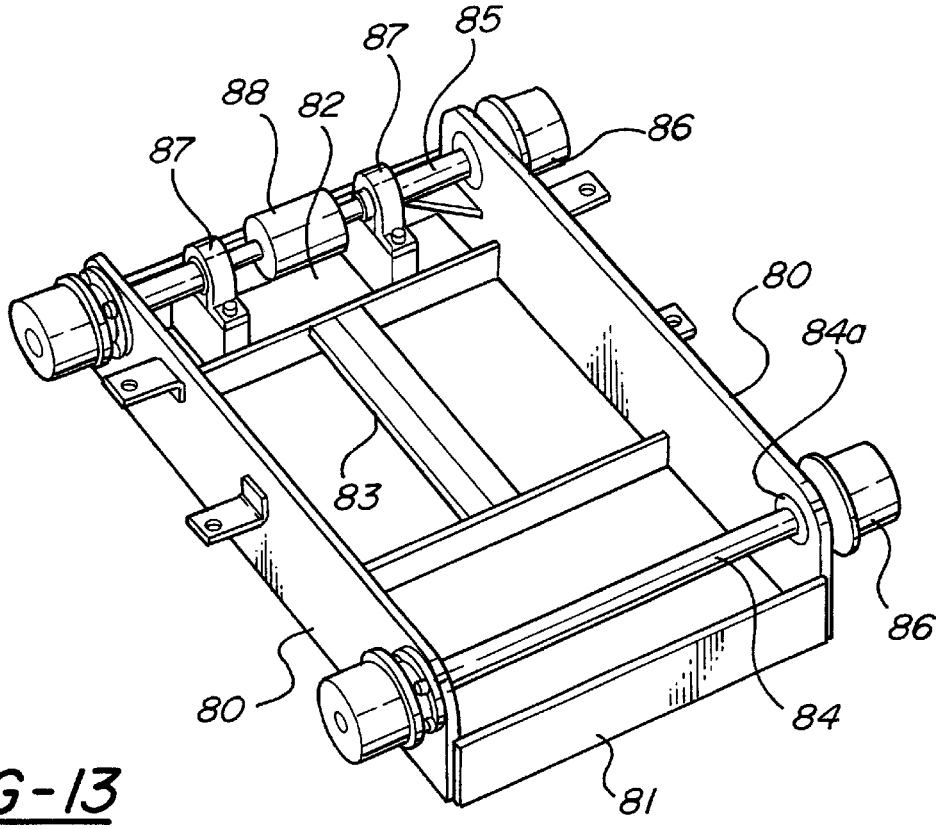
FIG-13
FIG-14
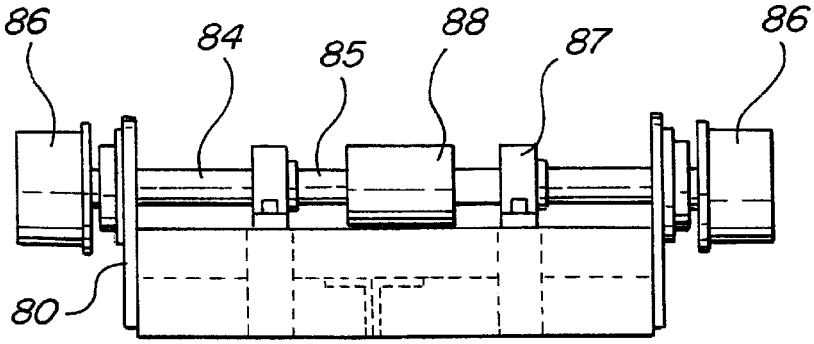

AUTOMATED MOLD CHANGING SYSTEM FOR CONCRETE PRODUCT MOLDING MACHINES AND METHODS OF CONSTRUCTING AND OPERATING THE SYSTEM

The present application claims the priority of U.S. provisional application Ser. No. 60/152,743 filed Sep. 8, 1999. The invention relates to the insertion and removal of the very heavy molds used in concrete products molding machines for molding concrete products such as concrete blocks. The system is designed to be used conjunctively with a concrete products molding machine to facilitate the ready changing of molds to produce different products in selected production runs.

BACKGROUND OF THE INVENTION

One approach to machinery for changing the relatively heavy, large, vibrated molds used in such machinery is disclosed in applicants' assignees' patent application, Ser. No. 828,260, filed Mar. 21, 1997, wherein the molds are fed from a replacement station linearly in a direction aligned with the extent of the mold support arms.

The present three-axis system has been developed as another approach for feeding a replacement mold longitudinally from one of a series of racks which are generally longitudinally in line with the molding machine to a position in front of the mold support arms, prior to moving the mold in to the mold support arms perpendicularly to its initial longitudinal travel.

In the past, mold changes were effected, perhaps only once a week, or once a month, but concrete product producers today must make a variety of products and may require a number of mold changes in a single workshift. Thus, it is no longer possible for operators to struggle with the manipulation of overhead crane machinery to accomplish this. Typically, with the present ever larger, high production molding machines being used today to increase capacity, the system must be capable of carrying molds as heavy as 4,000 pounds, for example.

SUMMARY OF THE INVENTION

The present system is a quick change system, which results in a minimum downtime for the machine, and greatly reduces the operator time and labor spent in changing molds. The system is required to accomplish in several minutes what previously took a great deal longer.

The present concrete products mold removal and replacement system for a concrete product molding machine and the methods of making and operating the system are concerned with a transfer carriage which is movable from a location remote from the mold support arms of the machine along a track leading longitudinally to a position abeam or in front of the outer ends of the mold support arms of the molding machine. The transfer carriage incorporates a cross carriage for movement transversely and an elevator carriage carried by the cross carriage and guiding on its guide system. The elevator carriage, which has a transversely extending mold support platform, is movable on the cross carriage into and out of the molding machine. A motor mechanism, which can be driven by a single motive source or a series of timed motor sources which operate conjunctively, is provided for moving the cross carriage transferred elevator transversely to a position below a mold on the molding machine support arms, and for raising the elevator carriage to move the platform upwardly to lift the mold from the arms, before returning the cross carriage outwardly. Then the transfer carriage is moved longitudinally away from the support arms to remove the mold to a remote position opposite a mold deposit station or rack on which the mold can be deposited. Then, after picking up a replacement mold, the transfer carriage is moved longitudinally once again toward the support arms to a position abeam of them. The cross carriage is moved inwardly once again and the elevator carriage is lowered to deposit the replacement mold on the mold support arms, before the cross carriage is returned to an out of the way position.

One of the prime objects of the invention is to design a system which can be manufactured economically and utilized with both new molding machines and those already in the field.

Another object of the invention is to provide a rapid mold change system which is efficient, durable and easy to maintain.

Other objects and advantages of the invention will become apparent with reference to the accompanying drawings and the accompanying descriptive matter.

THE DRAWINGS

The presently preferred embodiment of the invention is disclosed in the following description and in the accompanying drawings, wherein:

FIG. 3 is a fragmentary, schematic top plan view showing some of the skeletal framework for supporting the transfer elements of the system;

FIG. 4 is a schematic fragmentary side elevational view thereof;

FIG. 13 is a schematic perspective elevational view of the elevator-carrying inner carriage which rides transversely on the transport carriage;

FIG. 14 is an end view thereof;

SPECIFIC DESCRIPTION OF THE DRAWINGS

Figure 1:
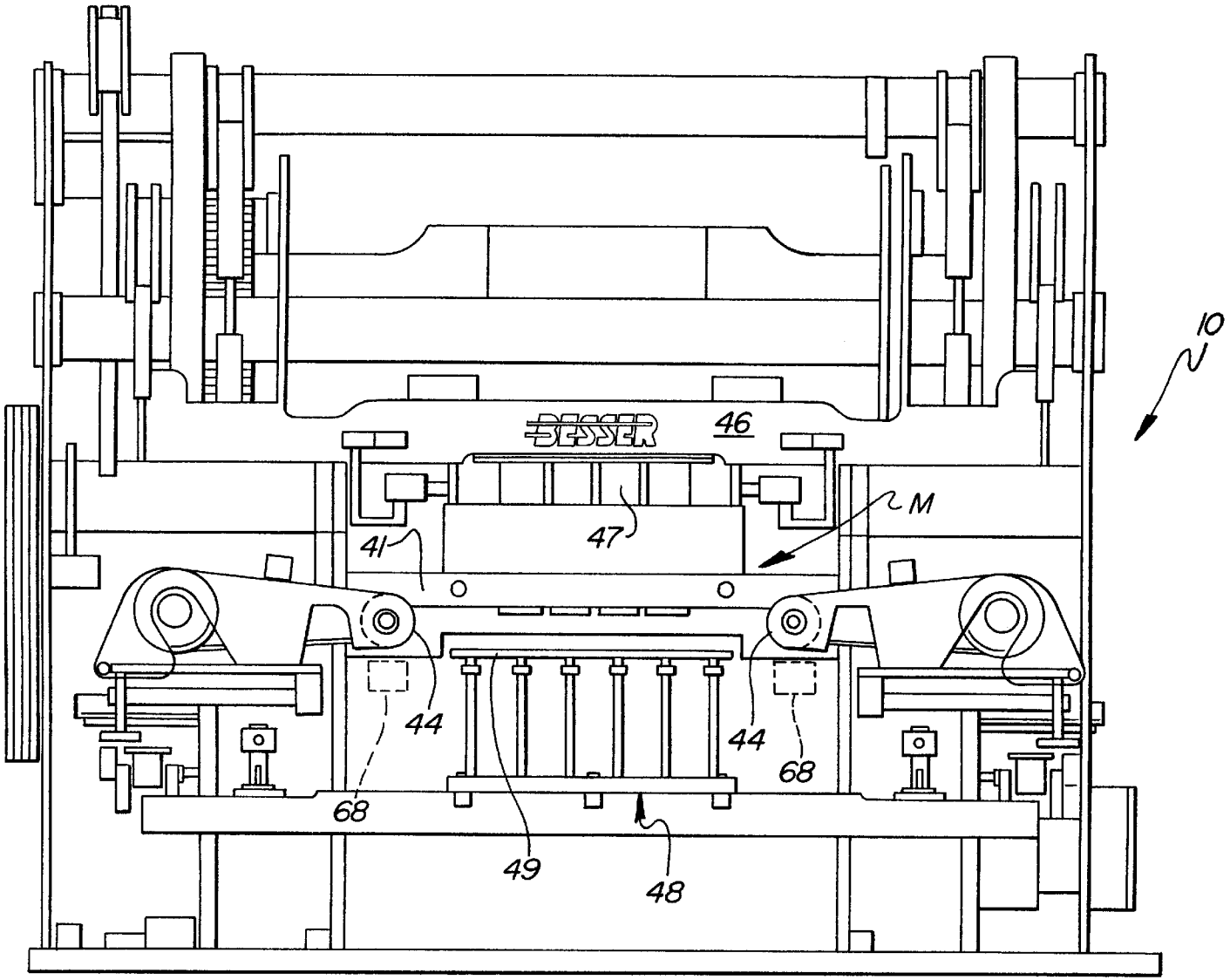
FIG. 1 is a schematic front elevational view illustrating certain components of a typical molding machine, the mold transport arms of the present invention being indicated only schematically.
Figure 2:
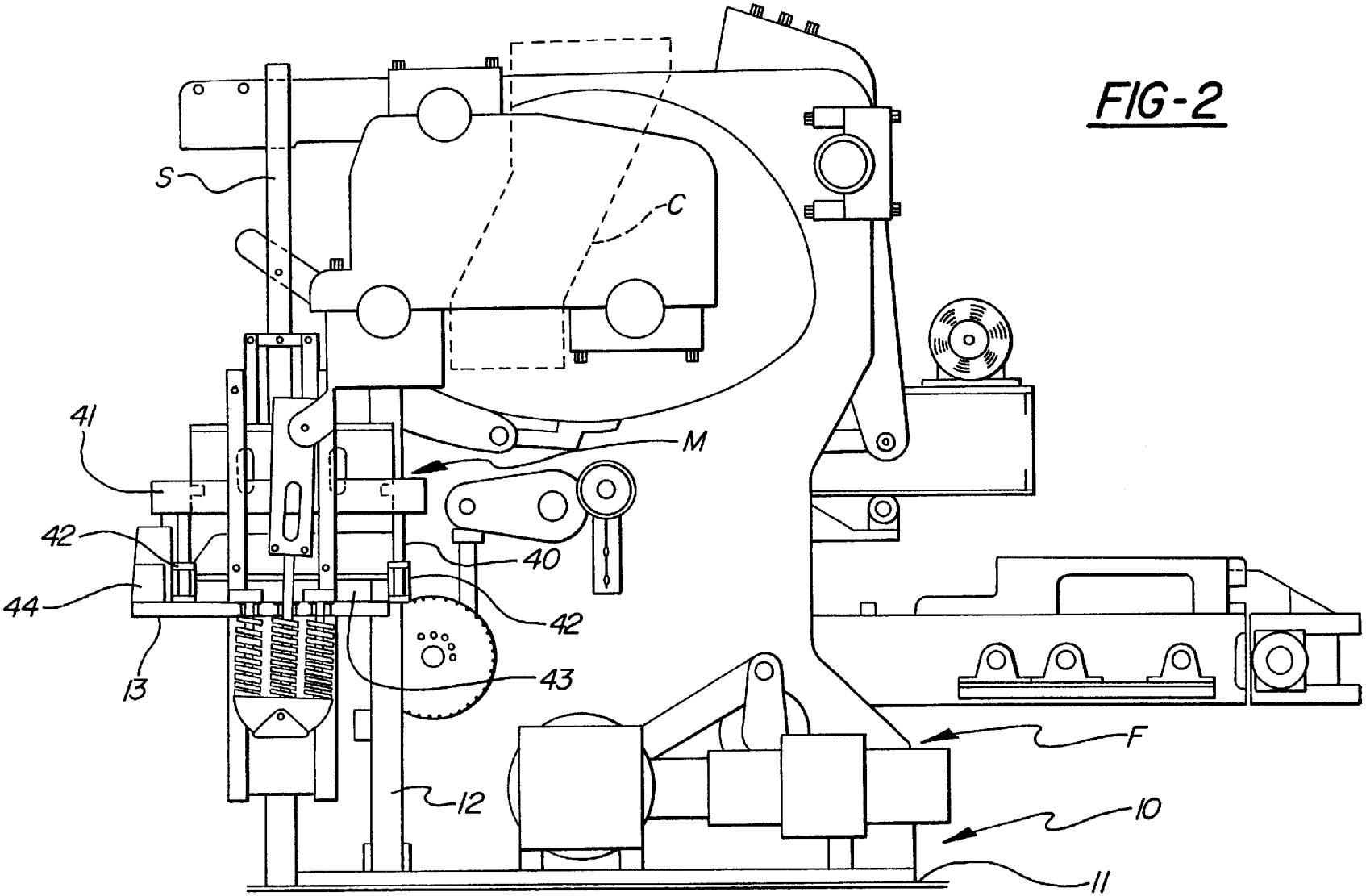
FIG. 2 is a schematic, fragmentary side elevational view of the molding machine only.

Referring now more particularly to the accompanying drawings, it is to be understood, first of all, that the concrete products molding machine, generally designated 10 in FIGS. 1 and 2, is illustrated only as being typical of this type of machinery and will not be described in any detail because the detail of the molding machine forms no part of the present invention.

Various elements of this type of machinery are disclosed in the present assignee's U.S. Pat. Nos. 4,235,580 and 4,312,242, which disclose a vibratory mold assembly of the general type which is contemplated to be inserted.

U.S. Pat. No. 4,941,813 disclosed a mold support assembly for one of applicant's assignee's machines which are known world wide as the BV 3-12, Dynapac, and Ultrapac Machines and have been in use for a number of years. All of these patents, and the patent to issue on applicant's assignee's aforesaid patent application, are incorporated herein by reference, and will facilitate an understanding of the general environment in which the present mold insertion system is to be operable.

The machine in U.S. Pat. No. 4,235,580 incorporates forwardly projecting arms which are notched to provide throats with flat horizontal support surfaces. It is upon these mold support surfaces that each open top and open bottom mold M is supported in the machine.

Figure 2A:
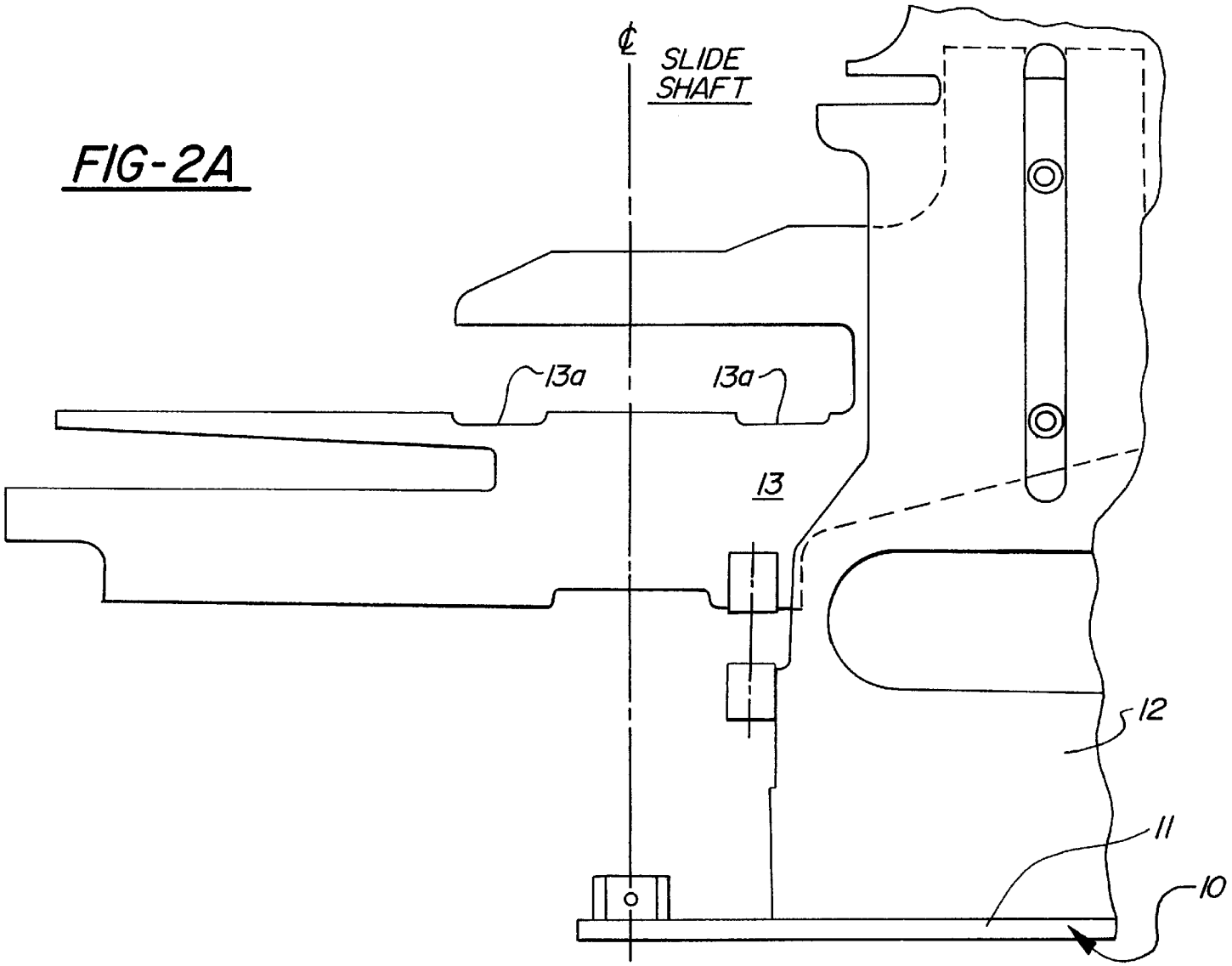
FIG. 2A is a fragmentary, schematic, side elevational view of some of the components thereof.

In FIGS. 1, 2, and 2A, the frame F of the molding machine 10 is illustrated as incorporating a frame bed 11 and side walls, plates, or frames 12. The plates 12 support a pair of outwardly projecting frame throat plates 13 (FIG. 2A) with projecting arms having mold support or throat surfaces 13*a* on which the mold, generally designated M, is to rest when it is moved interiorly into the machine 10 and lowered. A typical mold M, which includes compartments within which the concrete mix is molded in the usual manner, is normally partitioned for simultaneously forming a plurality of products and has spaced apart, vertically extending mold frame or side bar members 40 depending from the usual laterally projecting mold top plate frame 41, which is received on the throat surfaces 13*a* when the mold M is lowered.

The frame side bars 40, which transmit vibratory motion to the mold cavities, support the vibration shaft bearings 42 for the pair of vibratory shafts housed in shaft assembly housings 43. The drive shaft assemblies for driving each of the vibratory shafts are shown at 44 and it is these sheave assemblies 44, and the opposite bearings 42, which are supported on the arms 13, and on the transfer carriage platform to be described.

As is well known, once the mold M is in position, it is locked in place, but supported in a manner which permits it to be lifted off the throat supports 13*a* by a pallet support and supply assembly 48 during normal operation of the molding machine to permit the vibratory shafts in housings 43 to vibrate the mold M, thereby effecting even distribution and compaction of the moldable concrete material throughout the mold.

The chute or concrete mix supplying element C, for filling the mold in the first place, is shown in an interior position in which it can fill a feedbox incorporated with it, which is movable in the usual manner to a position directly above the mold M to charge the mold with the concrete mix.

During the time that the vibrator shafts are operating, there is a stripper head frame assembly 46, which is lowered by its drive so as to cause the stripper heads 47 to enter the mold to the level permitted by stop members. Upon engagement of the stripper heads with the stop members, vibration of the mold is discontinued and it is customary then to strip the molded product or products from the mold, immediately following the termination of vibration, by simultaneously effecting downward movement of the stripper head assembly 46 and the pallet support assembly 48, which has been moved upwardly in the first place to clamp the pallet 49 to the bottom of the mold M.

THE MOLD TRANSFER SYSTEM

With reference now, in the first instance, particularly to FIGS. 3–7, the carriage support and track framework assembly is shown, as incorporating alternate mold deposit and storage racks 1 and 2, which together support longitudinally extending main transfer tracks 50 and 50*a*. The rack 1 and the rack 2 each comprise vertically extending corner posts 51 for supporting the track 50*a*. Track 50 may be supported by framework including posts 55. Upper and lower side and end horizontal brace members 52 and 53 (FIG. 4), and cross diagonal brace members 54, can be provided as shown to rigidify the framework. Racks 1 and 2 are similarly rigidified but are open at their inner sides confronting the adjacent side track 50*a*.

Figure 5A:
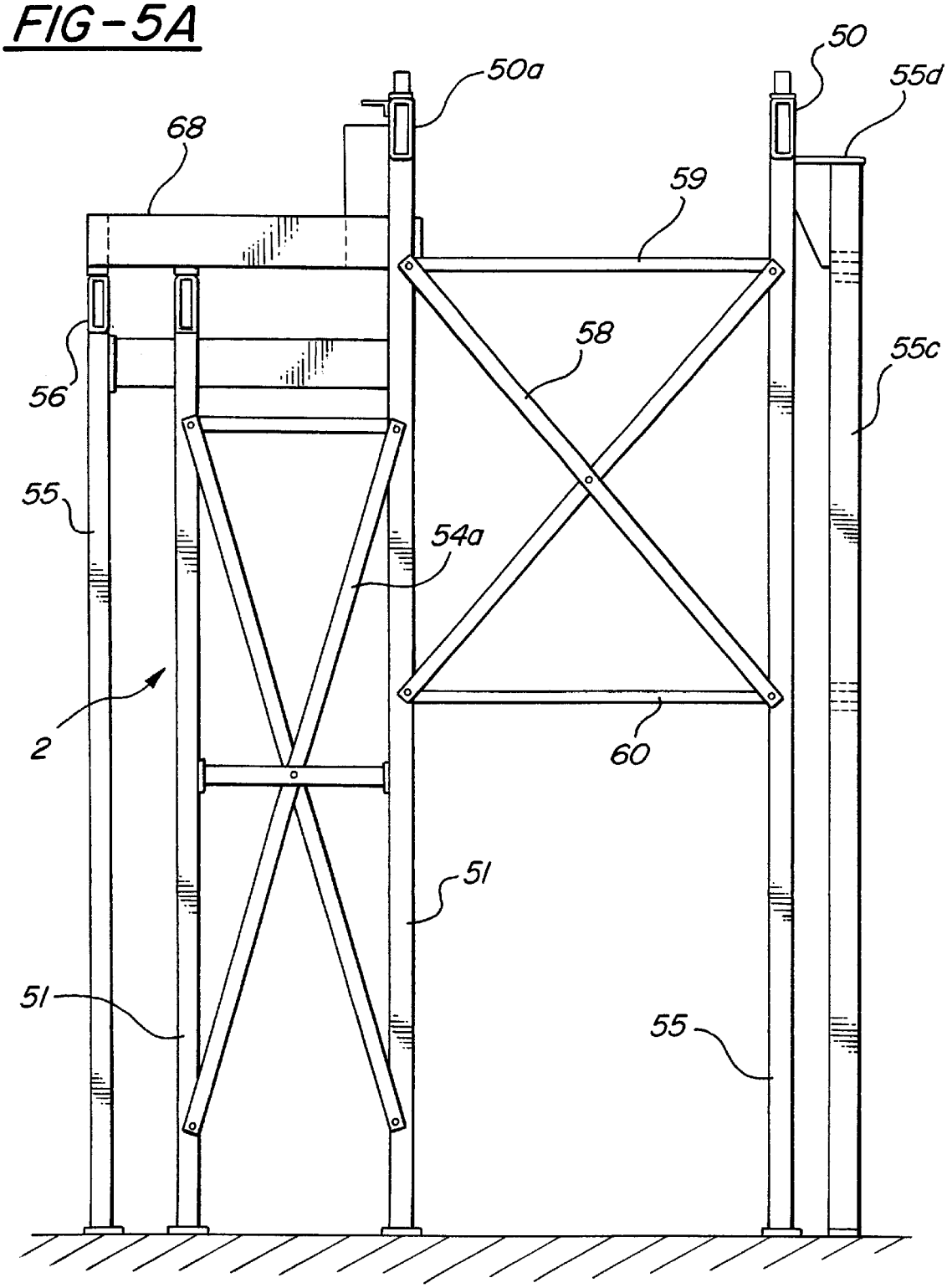
FIG. 5A is a schematic left end elevational view thereof.
Figure 5B:
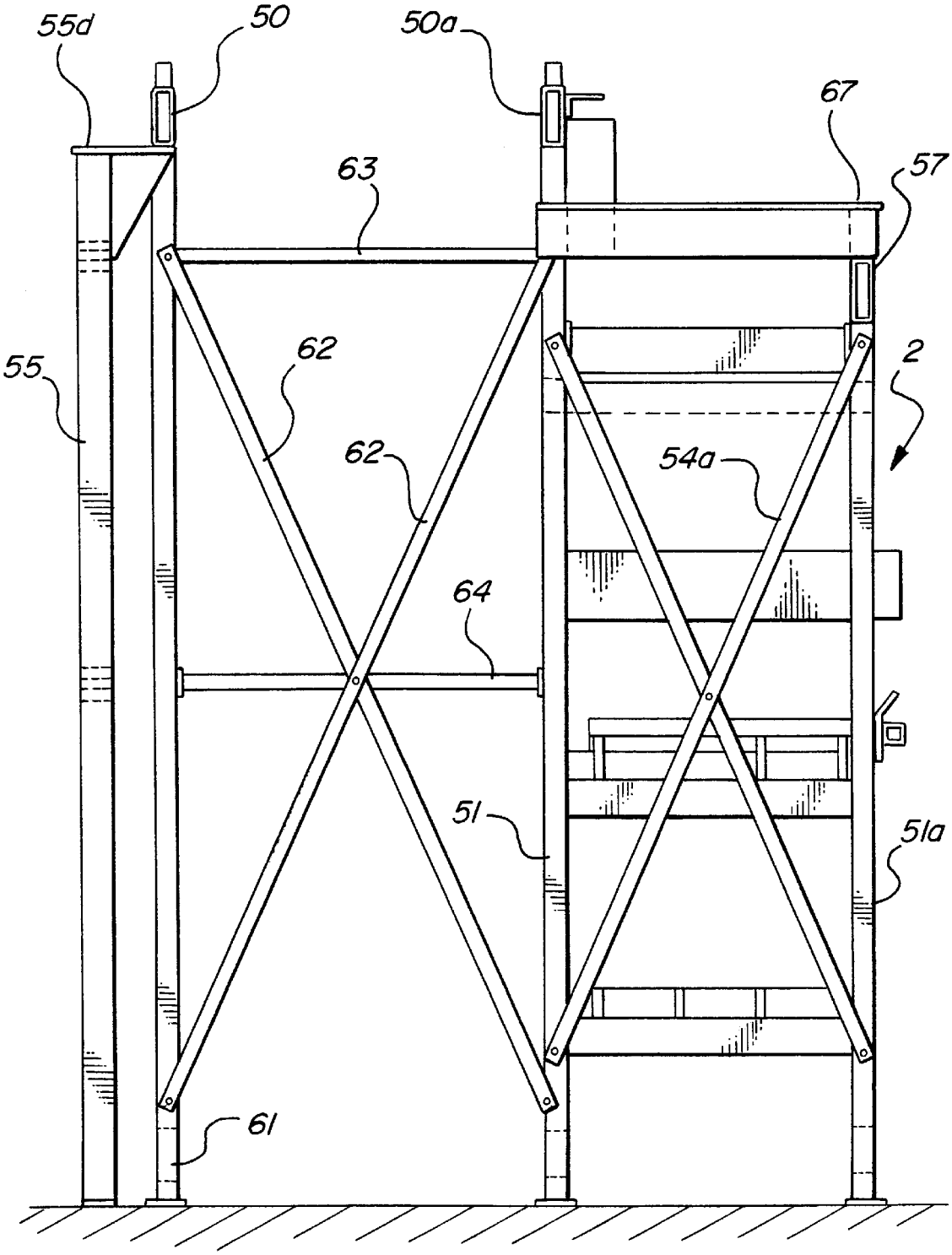
FIG. 5B is a schematic right end elevational view thereof.

Longitudinal frame members 56 and similar longitudinal support tubes 57 are supported by the framework, including end member 55*b* at a level below tracks 50*a*. At the opposite side, mid-support posts 55*c* connect with the posts 55 as shown in FIG. 5A. As FIGS. 5A and 5B particularly show, diagonal brace cross members 58 and upper and lower brace members 59 and 60 connect the support posts 51 with posts 55*c* at one side, and cross brace members 62 and upper and lower brace posts 63 and 64 connect the rack posts 51 with posts 55*c* at the other side. As FIG. 4 indicates, each of the racks 1 and 2 has multiple vertically spaced pairs of laterally spaced horizontal supports 65 on which a mold M may be supported so that each of the racks 1 and 2 can support multiple molds, at what may also be termed the mold deposit or mold pick-up stations 1 and 2.

Figure 6:
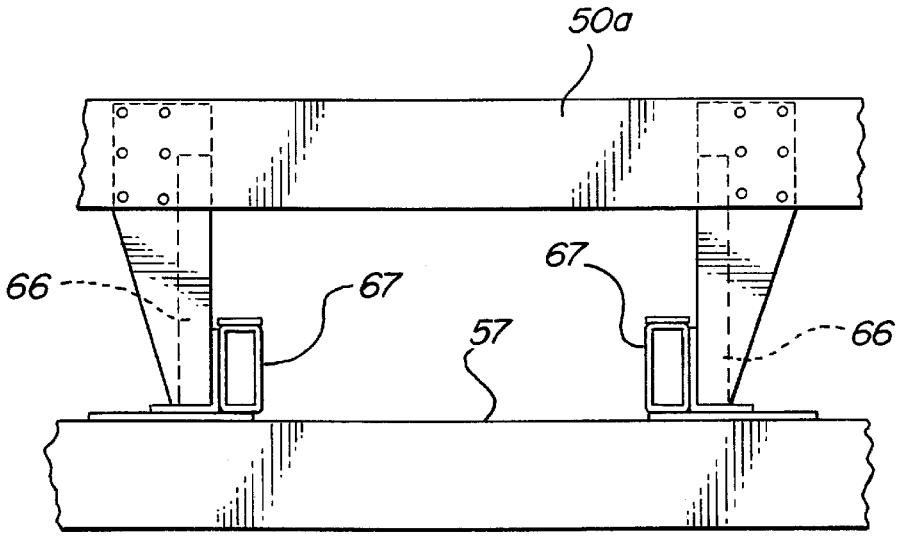
FIG. 6 is an enlarged, schematic fragmentary side elevational view of an upper portion of the framework taken at the machine transfer station.
Figure 7:
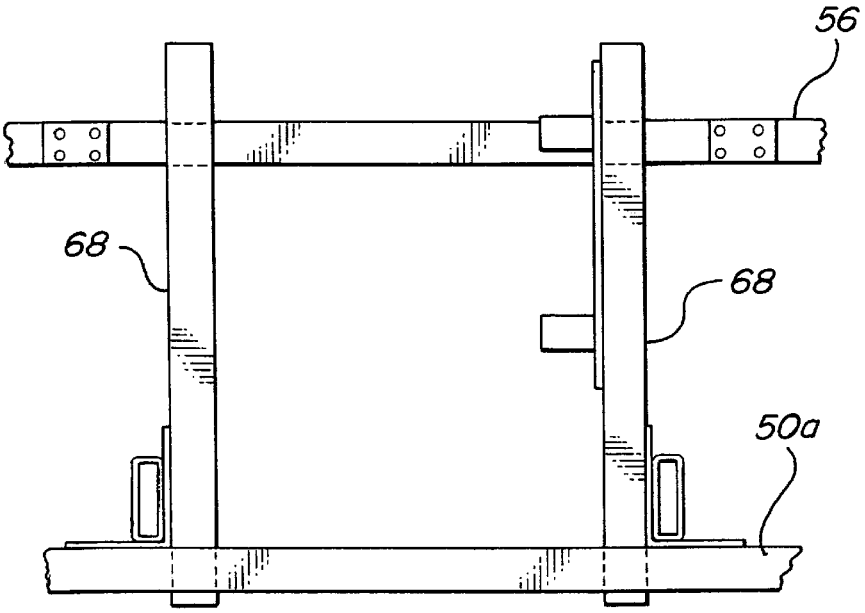
FIG. 7 is a top plan view thereof.

FIGS. 6 and 7 show the beams 57 which are supported by the racks 1 and 2 for a purpose to be presently described. At each of the racks 1 and 2, vertical supports 66 support cross tracks 67 at what may be termed a rack transfer station. Similar supports 66 are provided for cross tracks 68 at what may be termed a machine transfer station 3.

Figure 8:
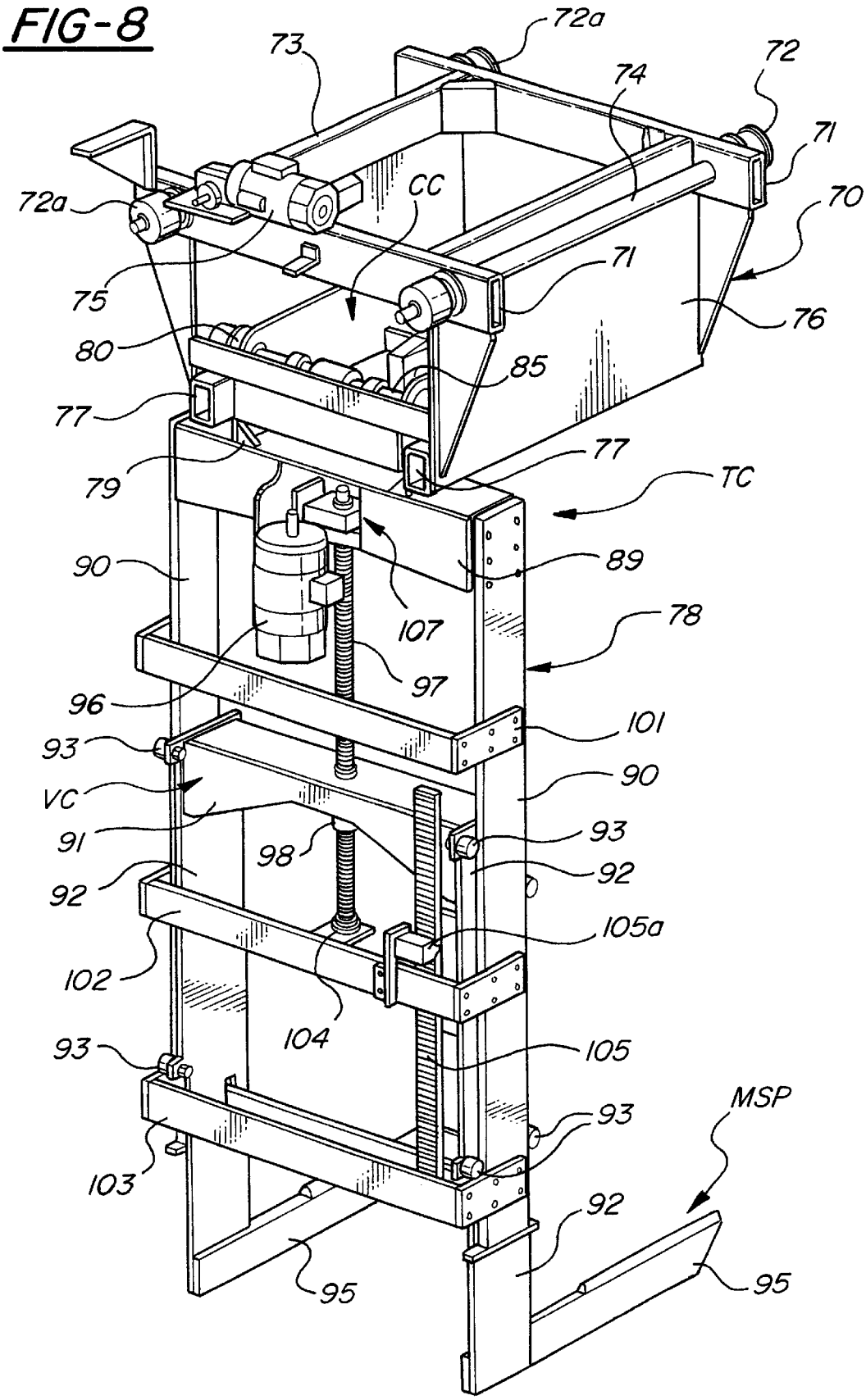
FIG. 8 is a schematic perspective elevational view of the transport carrier which travels longitudinally on the framework.
Figure 9:
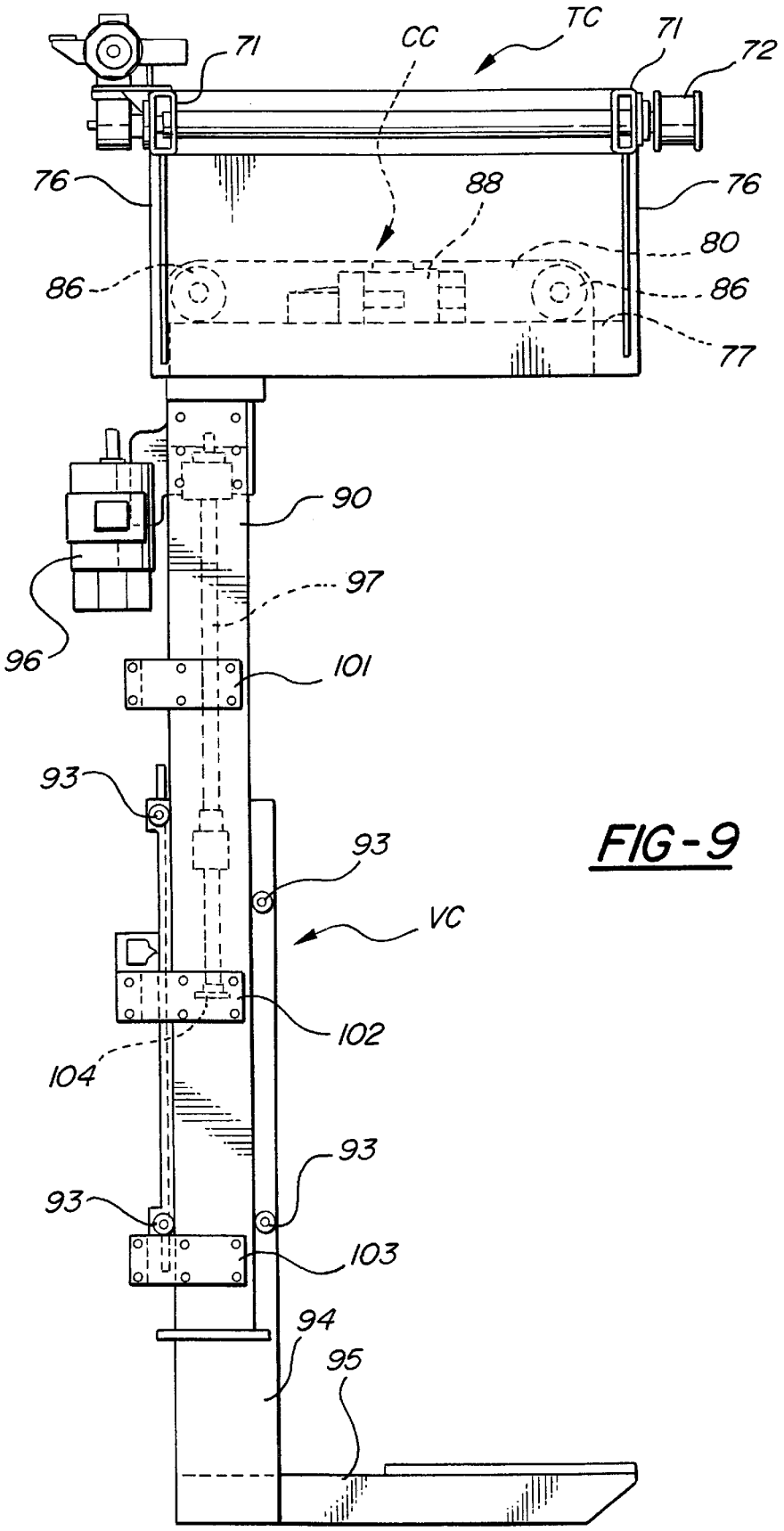
FIG. 9 is a side elevational view thereof.
Figure 10:
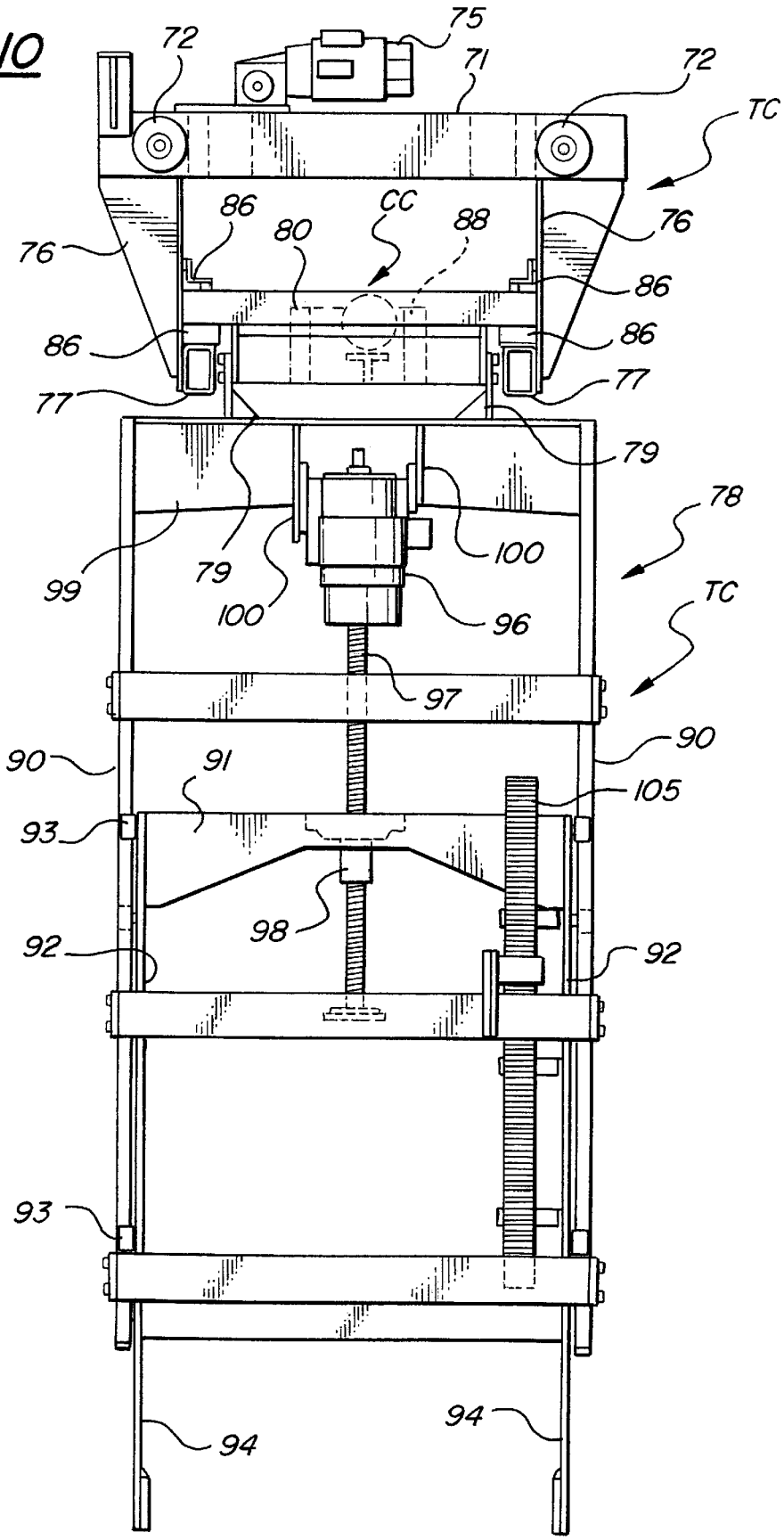
FIG. 10 is an end elevational view thereof.

FIGS. 8–10 particularly schematically illustrate the transport carrier, which moves longitudinally along tracks 50 and 50*a*. As FIG. 8, particularly shows, the transfer carrier, generally designated TC, comprises a longitudinally movable carriage frame, generally designated 70, including longitudinally extending side support tubes 71 on which the rollers 72 and 72*a*, which travel along tracks 50 and 50*a*, are supported on shafts 73 and 74. Rollers 72*a*, on shaft 73, are fixed to be driven by a motor 75, whereas the rollers 72 on shaft 74 can be journaled on the shaft 74 or also driven by motor 75 via a suitable chain drive.

Dependent from the tubes 71 are end plates 76, mounting support tubes 77 which form cross tracks for an inner transversely moving cross carriage, generally designated CC, which will later be described in more detail. It is the cross carriage CC which moves across to the pairs of tracks 67 and 68 when the transfer carriage TC is appropriately positioned opposite either of the racks 1 or 2, or the machine transfer station 3. The inner carriage CC, which travels on the tracks 77, supports an elevator frame, generally designated 78, on dependent angle plates 79 which are bolted or otherwise secured to the side plates 80 of the inner carriage CC, as shown particularly in FIG. 10.

Figure 11:
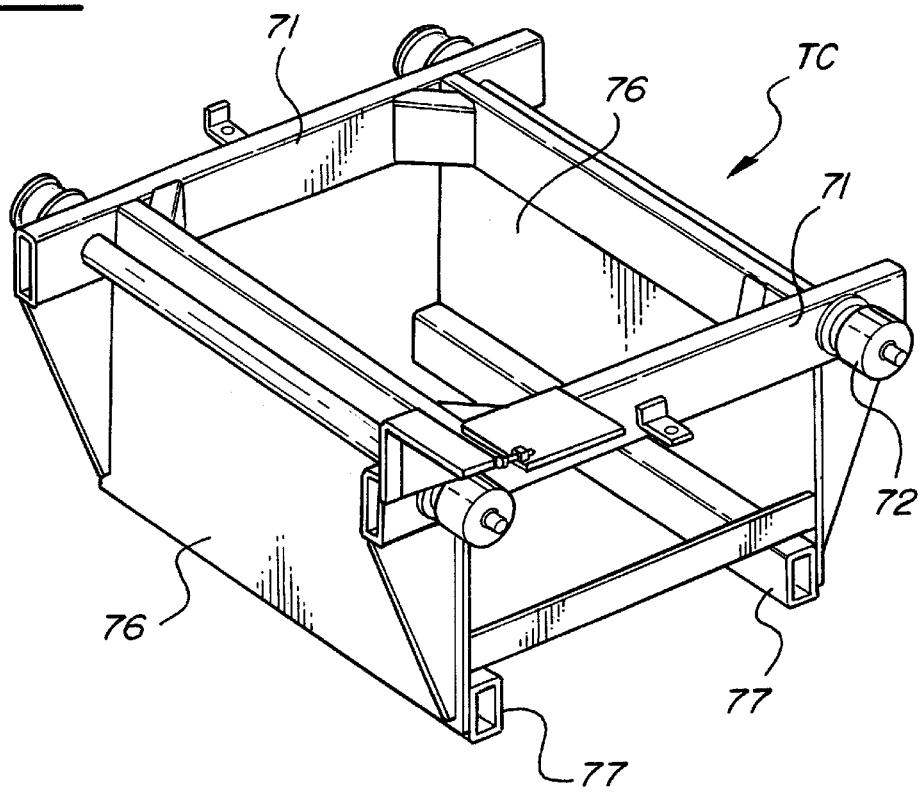
FIG. 11 is a schematic perspective elevational view of the upper portion of the transport carrier only.
Figure 12:
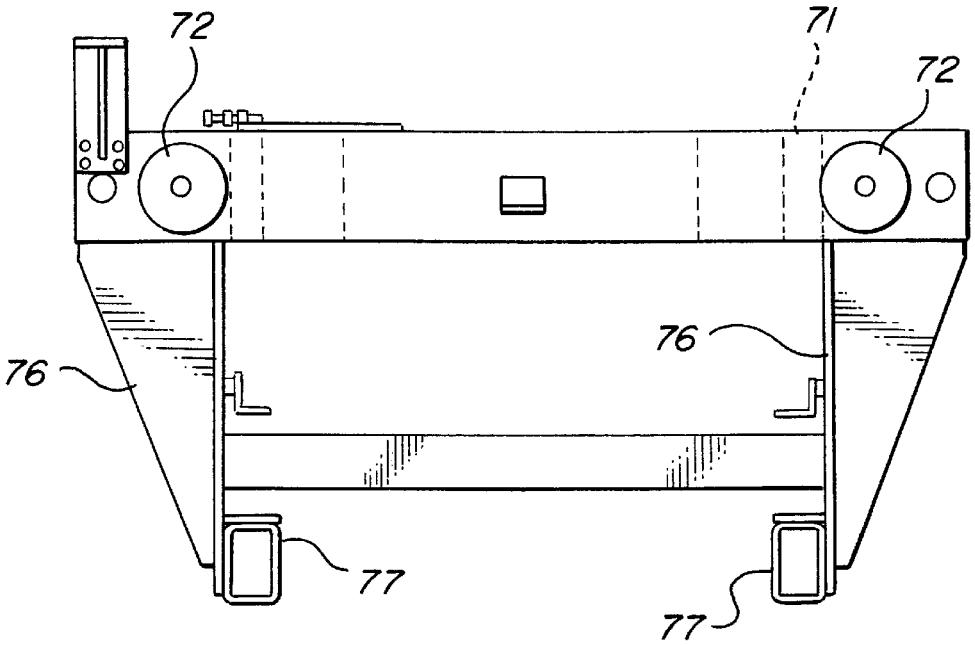
FIG. 12 is an end elevational view thereof.

More detailed views, FIGS. 13 and 14, depict the inner carriage CC, with the transfer carriage frame shown in FIGS. 11 and 12 and the elevator frame 78 omitted from the views, and it will be noted that channel plate 81 spans the side plates 80 at one end and an angle plate 82 spans the side plates 80 at the other, the plates being connected by a central support 83. Shafts 84 and 85 span the side plates 80 and mount the flanged rollers 86, which travel on tracks 77 (FIGS. 11 and 12). Bearings 87 are provided for the split shaft 85, which is coupled at 88*a* and may be appropriately driven by an electrical motor 88 (FIG. 9) via suitable sprockets and chains or the like. Shaft 84 may be journaled by bearings 84*a*.

The elevator frame 78 includes an upper channel beam 89 having fixed to it dependent vertical beams 90, which function as guide and support beams for an interior vertically movable carriage, generally designated VC. Elevator vertical carriage VC includes a top plate 91 fixed to side plates 92, which are disposed interiorly of guide plates 90 and travel therealong on guide rollers 93. At its lower end, the vertically traveling carriage VC carries lift arms, legs, or forks 95, which may be said to comprise a mold support platform MSP. As FIGS. 8, 9 and 18, particularly indicate, an electric motor 96 may be provided to move the carriage VC upwardly and downwardly by means of a drive screw 97 which extends through a suitable ball nut 98 carried by the elevator top frame member 91. The motor 96 is appropriately supported on the plate 89, which spans plates 90 on supports 100, and the drive assembly 96 incorporates suitable drive members for revolving screw 97 while preventing it from moving vertically.

Brace straps 101, 102, and 103 embrace and connect the guide members 90 and, it will seen, that the lower end of screw 97 is journaled in an appropriate bearing 104 carried by the brace strap 102. A vertically disposed limit switch cam track of known type 105 may also be employed on the carriage VC along with suitable limit switches 105*a* on frame member 102 for appropriately slowing and halting the elevator carriage VC at appropriate levels.

Figure 18:
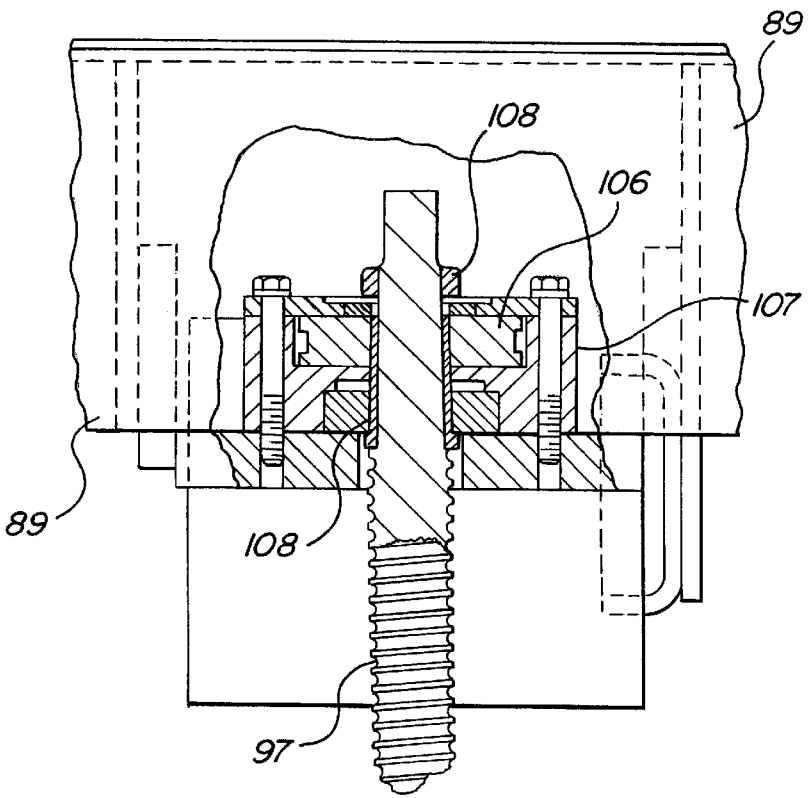
FIG. 18 is an enlarged, partly sectional, fragmentary, elevational view of the upper end of the elevator screw and its drive assembly taken on the line 14—14 of FIG. 14.
Figure 15:
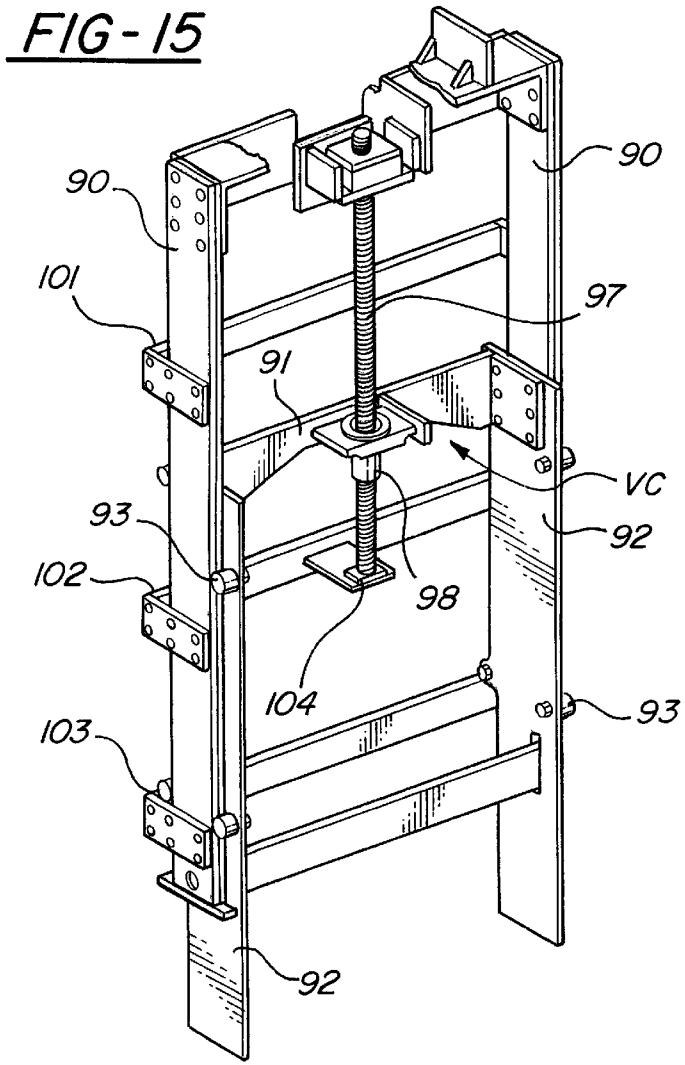
FIG. 15 is a schematic, fragmentary, perspective elevational view of the elevator carriage which is supported on the inner carriage, the mold carrying arms being omitted in the interests of clarity.
Figure 16:
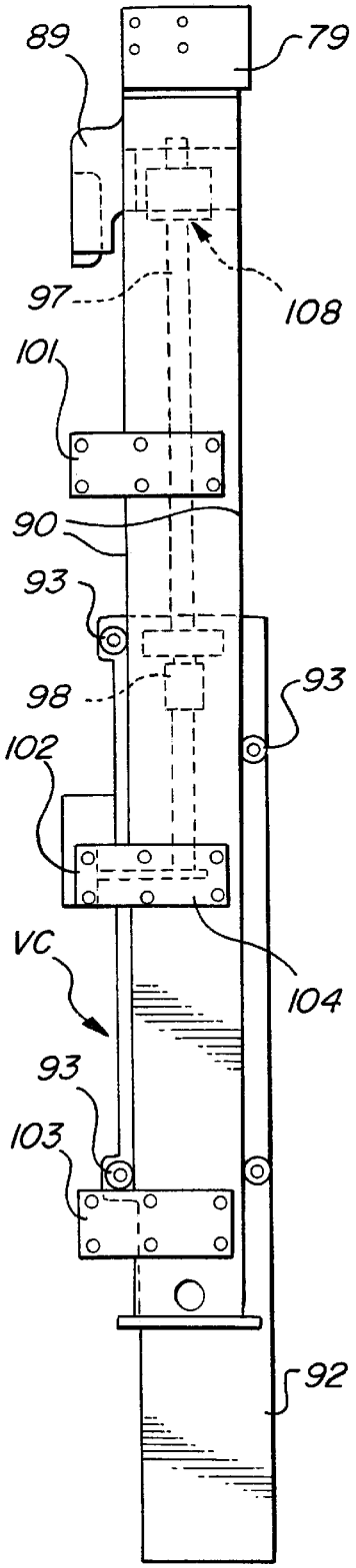
FIG. 16 is a side elevational view thereof.
Figure 17:
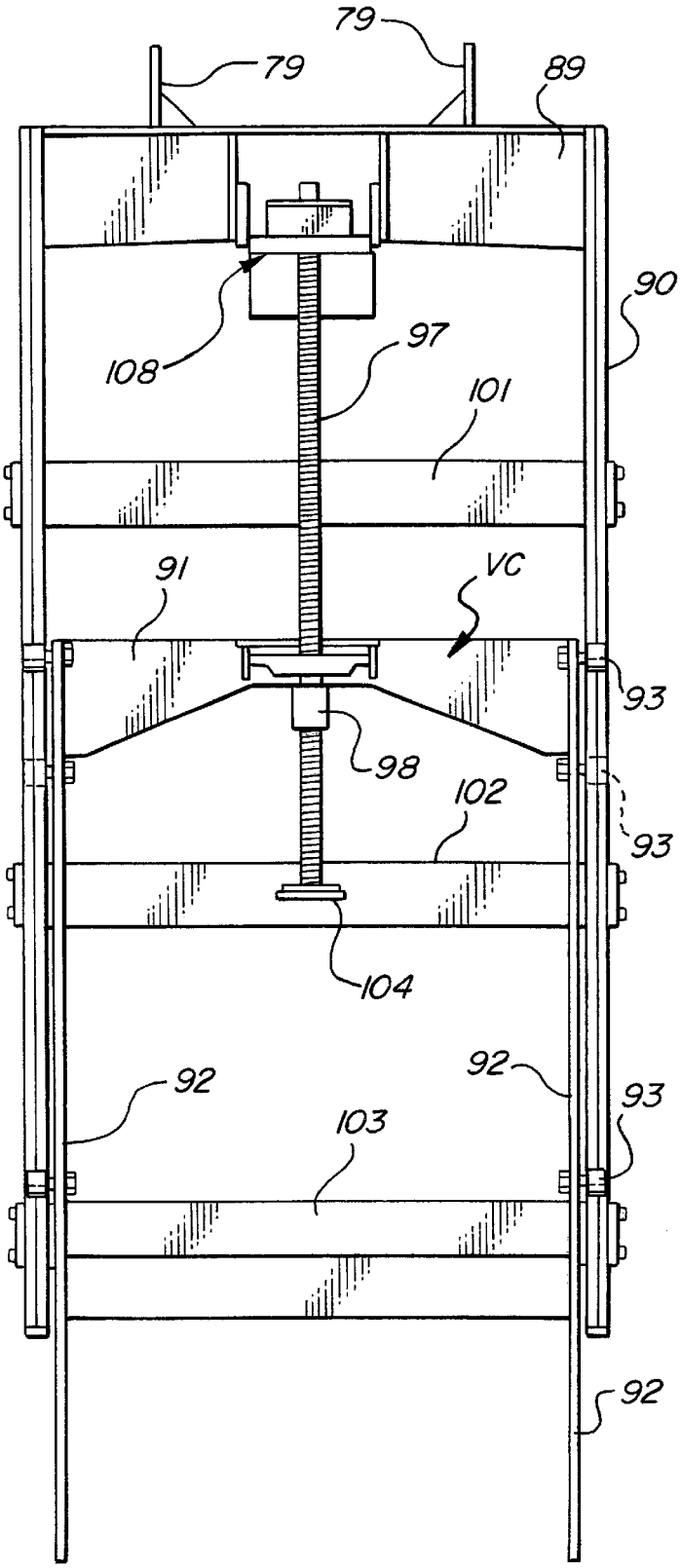
FIG. 17 is an end elevational view thereof.

As FIG. 18 indicates, the motor 96 drives axially immobile screw 97 through a drive sheave 106 fixed to the screw 97 and disposed within a housing, generally designated 107, which includes suitable bearings 108.

THE OPERATION

It is to be understood that the reversible electric motors 75, 88, and 96 shown may be operated by suitable limit switches which first slow down and then stop the movement which they create. The control system which slows and stops is conventional and, alternatively, a conventional programmable controller may be employed, or other forms of control or drive may be employed.

When a mold is to be changed, there are certain steps performed by the operator at the machine to condition the mold for travel. Without going into detail as to this, it will be necessary to remove the vibrator belts and unlock the mold.

Assuming that the transfer carriage TC has traveled longitudinally along tracks 50 and 50*a* from a remote position to a position at station 3 in front of or abeam of the mold support arms 13, that the carriage CC is rearwardly disposed on the tracks 77, within the transfer carriage 70, and that the arms or forks 95 are empty, it will be necessary to, first of all, activate motor 96 to lower the carriage VC to a level at which the arms or forks 95 are disposed below the mold M supported on machine arms 13. At this time, motor 88 is activated to drive the split shaft 85 in a direction to move the transverse carriage CC inwardly toward the machine and onto tracks 68 to dispose the arms 95 beneath the mold M. When the inwardmost position is reached and motor 88 is first slowed and then halted, the motor 96 is operated to raise the elevator carriage VC and lift the mold M off its mold support arms 13. Then, motor 96 is halted and motor 88 is driven in a reverse direction to move the carriage CC from the station 3 tracks 68 back onto the tracks 77 to the position shown in FIG. 8. At this time, motor 88 is halted and motor 75 is energized to drive the entire transfer carriage TC longitudinally on rails 50 and 50*a* to a position opposite one of the racks 1 or 2 which has an empty pair of support platforms 65. Typically, the elevator carriage VC is then adjusted via motor 96 to move the forks 95 to load the mold to the particular set of spaced apart support angles 65 which are to receive the mold M. This is done by moving the elevator carriage to a position to dispose the support surfaces of the mold at a level above empty support angles 65 and then moving the carriage CC into the rack on support tracks 67 to position the mold above the empty angle supports 65. The elevator VC can then be activated by motor 96 to lower arms 95 and deposit the mold on the empty supports 65 before carriage CC is operated by motor 88 to return the carriage CC to tracks 77. Alternatively, of course, the elevator carriage VC could have been adjusted to such a "ready to deposit" vertical position while the carriage was opposite station 3.

Assuming the mold to be replaced in the machine is not in the same rack, the motor 75 may then need to be activated to drive the carriage TC along rails 50 and 50*a* to the rack station where a new mold is to be picked up. The elevator carriage VC is then operated via motor 96 to lower the carriage VC to position the arms 95 at a level under the mold to be picked up. At this time, the motor 88 operating carriage CC is activated to move the carriage CC forwardly to the tracks 67 of the particular rack station involved to dispose forks 95 under the mold to be picked up. If the mold to be picked up is at the same rack station upon which the mold changed has.been deposited, it will not be necessary, of course, to reposition the transfer carriage TC to the other rack station, prior to performing the pick-up step. Either way, the carriage VC is then operated via motor 96 to raise the carriage VC and lift the mold M to be replaced off its supports 65, after which the carriage CC is operated to move back onto the tracks 77.

When this is accomplished, the motor 75 is again activated and the entire carriage TC is moved along the tracks 50 and 50*a* to the installation position at machine transfer station 3 opposite the tracks 68, wherein tracks 77 align with the tracks 68. The elevator carriage VC is then again operated to bring the arms 95 carrying the replacement mold to a level above the supports arms 13 and then carriage CC, via motor 88, is operated to move inwardly to position the arms 95 in an interleaved position with the support arms 13. When carriage CC reaches this position on the tracks 68 and motor 88 is halted, motor 96 is activated to lower the elevator carriage VC and lower the arms 95 to a position in which the mold M is deposited on the machine arms 13. At this point, with the arms 95 lowered sufficiently to a position of clearance with the mold, carriage CC is operated in the reverse direction via motor 88 until the elevator carriage VC is disposed in its outward position with carriage CC supported on the rails 77. Support carriage TC can then be moved in a direction along rails 50 and 50*a* to a remote location until it is necessary to once again change molds.

Typically, the entire operation may be push button initiated with the motor stops and slow downs controlled by limit switches, or some of the sequencing may be automated by a programmable controller.

The disclosed embodiment is representative of a presently preferred form of the invention, but is intended to be illustrative rather than definitive thereof. The invention is defined in the claims.

We claim:

1. A concrete product mold removal and replacement mechanism for a concrete product molding machine having mold support frame structure includes a transfer carriage movable from a mold deposit location remote from said mold support frame structure on the machine along a pathway leading longitudinally abeam of said mold support frame structure and further comprises:

a. a cross carriage and elevator assembly, having a mold support, carried on said transfer carriage for travel relative to the transfer carriage to facilitate movement to and from said mold deposit location and to and from said mold support frame structure;

b. said assembly including an elevator and incorporating guides carried by one of said cross carriage and elevator for the other to move therealong; and c. motor mechanism for moving said transfer carriage longitudinally adjacent said machine and moving said cross carriage transversely inwardly to a position below a mold on said mold support frame structure, raising said elevator to deposit said mold on said mold support, returning said cross carriage transversely and moving said transfer carriage longitudinally to remove said mold to a position opposite said mold deposit location, moving said cross carriage transversely to deposit said mold at said deposit location; returning said cross carriage with a replacement mold and moving said transfer carriage longitudinally toward said mold support frame structure to a position abeam of said structure, and moving said cross carriage inwardly and lowering said elevator to deposit the replacement mold on said mold support frame structure.

2. The mechanism of claim 1 including said concrete products molding machine in combination, said molding machine having a vibratable mold with at least one vertically open cavity supported on said mold support frame structure, a pallet receiver movable vertically for lifting a pallet to close the bottom of said mold cavity, and a stripper head assembly which is movable down to remove the molded product from said cavity.

3. The mechanism of claim 2 wherein said pathway is defined by a pair of transversely spaced apart frame supported tracks and said transfer carriage has transversely spaced wheels riding thereon; said transfer carriage mounts a pair of longitudinally spaced transversely extending tracks and said cross carriage has longitudinally spaced wheels riding thereon; and said elevator comprises a vertically extending guide frame fixed to said cross carriage to depend therefrom and an elevator carriage carrying said mold support movable upwardly and downwardly on said guide frame.

4. The mechanism of claim 3 wherein said mold support comprises a pair of longitudinally spaced arms.

5. The mechanism of claim 3 wherein a vertically extending screw and nut assembly for moving said elevator carriage upwardly and downwardly connects said elevator carriage with a motor carried on one of said guide frame and said elevator carriage.

6. The mechanism of claim 3 wherein said cross carriage carries a motor connected to drive said cross carriage wheels and said transfer carriage carries a motor connected to drive said transfer carriage wheels.

7. The mechanism of claim 3 wherein a pair of transversely extending tracks project from said frame to extend toward said molding machine to support said cross carriage for to and fro travel thereon and wherein said mold deposit location includes a pair of longitudinally adjacent racks positioned adjacent said longitudinally extending tracks having vertically spaced mold support members extending perpendicularly to said longitudinally extending tracks, and pairs of transversely extending tracks at each rack, at the level of said tracks extending toward said molding machine, to support said cross carriage for travel to and from said mold support members of said racks.

8. The mechanism of claim 7 wherein said tracks extending toward said molding machine and said tracks extending toward said racks are mounted in parallelism by said frame.

9. The mechanism of claim 3 wherein one of said elevator carriage and elevator guide frame mounts guide rollers in vertically spaced relation.

10. The mechanism of claim 8 wherein a housing depends from said transfer carriage and supports said cross carriage tracks and said cross carriage.

11. A concrete product mold removal and replacement mechanism in combination with a concrete product molding machine having a mold with at least one vertical through cavity supported on mold supports, a pallet receiver movable vertically for lifting a pallet to close the bottom of said mold cavity, and a stripper head assembly which is movable down to remove the molded product from said cavity conjunctively with downward movement of the pallet receiver and including:

a. a frame and a transfer carriage movable thereon from a location longitudinally remote from said mold supports on the machine along a pathway leading longitudinally abeam of said mold supports, said pathway being defined by a pair of transversely spaced apart frame supported tracks and said transfer carriage having transversely spaced motor driven wheels riding thereon;

b. a cross carriage and elevator assembly carried on said transfer carriage and incorporating a cross carriage carried for movement transversely to facilitate movement to and from said mold supports, and an elevator having a vertically movable member, said transfer carriage mounting a pair of longitudinally spaced transversely extending tracks and said cross carriage having longitudinally spaced wheels riding thereon; and said elevator comprising a vertically extending guide frame fixed to said cross carriage to depend therefrom and an elevator carriage with a pair of longitudinally spaced arms movable upwardly and downwardly on said guide frame ; and c. motor mechanism for moving said cross carriage transversely inwardly and raising said elevator member to remove a mold carried on said mold supports, returning said cross carriage transversely and moving said transfer carriage longitudinally outwardly; returning said transfer carriage after the mold is replaced, longitudinally toward said mold supports to a position abeam of them; and moving said cross carriage transversely inwardly and lowering said elevator member to deposit a replacement mold on said mold supports.

12. The mechanism of claim 11 wherein a pair of transversely extending tracks project from said frame to extend toward said molding machine to support said cross carriage for to and fro travel thereon and wherein a mold deposit and pickup station is provided which includes a pair of longitudinally adjacent racks positioned adjacent said longitudinally extending tracks and has vertically spaced mold support members extending perpendicularly to said longitudinally extending tracks, and pairs of transversely extending tracks at each rack are provided at the level of said tracks extending toward said molding machine to support said cross carriage for travel to and from said mold support members of said racks.

13. A method of operating a concrete product mold removal and replacement mechanism for a concrete product molding machine which includes a frame; a transfer carriage movable thereon from a location remote from mold supports on the machine along a pathway leading longitudinally abeam of said mold supports; a cross carriage carried on said transfer carriage for movement transversely to the transfer carriage; and an elevator carried by said cross carriage having a vertically movable transversely extending elevator mold support platform; the steps comprising:

a. moving said transfer carriage longitudinally adjacent said machine and moving said cross carriage transversely inwardly to a position below a mold on said mold supports;

b. raising said elevator platform to move said platform upwardly to deposit said mold thereon;

c. returning said cross carriage transversely and moving said transfer carriage longitudinally to remove said mold to a position opposite a mold deposit and replacement station;

d. moving said cross carriage transversely to deposit said mold at said deposit and replacement station and to receive a replacement mold;

e. returning said cross carriage and moving said transfer carriage longitudinally toward said mold supports to a position abeam of said mold supports, and moving said cross carriage inwardly and lowering said elevator platform to deposit said replacement mold on said mold supports; and f. returning said cross carriage outwardly to said transfer carriage.

14. A method of constructing a concrete product mold removal and replacement mechanism for a concrete product molding machine, the mechanism including a frame and a transfer carriage movable thereon from a location remote from mold supports on the machine along a pathway leading longitudinally abeam of said mold supports, the steps comprising:

a. mounting a cross carriage on said transfer carriage for movement transversely to the transfer carriage;

b. mounting an elevator on said cross carriage having a vertically movable transversely extending elevator mold support platform; and c. connecting motor mechanism for moving said transfer carriage longitudinally adjacent said machine and moving said cross carriage transversely inwardly to a position below a mold on said mold supports, raising said elevator platform to deposit said mold thereon, returning said cross carriage transversely and moving said transfer carriage longitudinally outwardly to remove said mold to a remote location for mold replacement, moving the cross carriage transversely to deposit said mold being carried and to receive a replacement mold, returning said cross carriage and moving said transfer carriage longitudinally toward said mold supports to a position abeam of them, and moving said cross carriage inwardly and lowering said elevator platform to deposit said replacement mold on said mold supports.

15. The method of claim 14 comprising constructing said pathway as a pair of transversely spaced apart frame supported tracks and said transfer carriage with transversely spaced wheels riding thereon; constructing said transfer carriage with a pair of longitudinally spaced transversely extending tracks and said cross carriage with longitudinally spaced wheels riding thereon; and constructing said elevator as a vertically extending guide frame fixed to said cross carriage to depend therefrom and an elevator carriage carrying said platform movable upwardly and downwardly on said guide frame, and with a vertically extending screw and nut assembly for moving said elevator carriage upwardly and downwardly.

16. The method of claim 15 comprising providing a pair of transversely extending tracks to extend toward said molding machine to support said cross carriage for to and fro travel thereon; and providing a mold deposit and pickup station which includes a pair of longitudinally adjacent racks positioned adjacent said longitudinally extending tracks having vertically spaced mold support members extending perpendicularly to said longitudinally extending tracks, and providing pairs of transversely extending tracks at each rack, at the level of said tracks extending toward said molding machine, to support said cross carriage for travel to and from said mold support members of said racks.

* * * * *